US005570777A

United States Patent [19]

Skarivoda

[11] Patent Number: 5,570,777

[45] Date of Patent: Nov. 5, 1996

[54] CIRCUIT BOARD MOUNTED SWITCH ASSEMBLY

[75] Inventor: Edward L. Skarivoda, Manitowoc, Wis.

[73] Assignee: Paragon Electric Company, Inc., Two Rivers, Wis.

[21] Appl. No.: 511,541

[22] Filed: Aug. 4, 1995

[51] Int. Cl.[6] ..... H01H 9/00

[52] U.S. Cl. ..... 200/292; 200/240; 200/244; 200/291; 200/DIG. 29; 200/564

[58] Field of Search ..... 200/292, 240, 200/244, 245, 246, 291, 564, 565, 570, 547, 548, 11 B, 11 DA, DIG. 29

[56] References Cited

U.S. PATENT DOCUMENTS 2,753,432 7/1956 Long et al. .
2,765,454 10/1956 Long .
2,853,564 9/1958 Gahagan .
3,024,334 3/1962 Rhodes ..... 200/240
3,193,629 7/1965 Losch et al. .
3,346,708 10/1967 Morra ..... 200/564
3,470,334 9/1969 De Robertis et al. .
4,246,453 1/1981 Marchese et al. ..... 200/564
4,390,757 6/1983 Wiessner .
4,395,610 7/1983 Downs et al. .
4,596,907 6/1986 LaGreco et al. .
4,642,427 2/1987 Kratz et al. .

*Primary Examiner*—David J. Walczak
*Attorney, Agent, or Firm*—Foley & Lardner

[57] ABSTRACT

A switch integrally formed with a printed circuit board includes pairs of conductors printed on the board, a switch lever and a conductive sphere. The sphere is located in a hole in the lever and is held down against the conductors by a leaf spring which is riveted to the lever. The lever pivots relative to the board about a stud staked to the board. Each pair of conductors terminate at a depression within which the sphere rests to close the circuit between the pair of conductors.

25 Claims, 2 Drawing Sheets

CIRCUIT BOARD MOUNTED SWITCH ASSEMBLY

FIELD OF THE INVENTION

The present invention relates to a switching assembly integrally formed with a circuit board. In particular, the present invention relates to a switch which includes a switch member which can be manipulated by a user to roll a conductive, rolling contact to positions on the circuit board at which the electrical circuit between at least two conductors is completed.

BACKGROUND OF THE INVENTION

Switches integrally formed with circuit boards are known and used in various applications such as heating controls, cooling controls, humidity controls and other control system where it is practical to integrate the user interface (i.e. control switches) with the structure of the circuit board. For example, U.S. Pat. No. 4,395,610 issued to Downs et al. on Jul. 26, 1983, describes a switch for connecting a selected one of a plurality of multi-terminal connectors to a common connector. The switch includes a printed circuit board having a planar array of parallel conductors on at least one side of the board extending to the edge of the board, and fixed female connectors having elastically deformable contacts selectably engageable with the planar edge contact. Engagement is achieved by pivoting the printed circuit board to the selected female connector position. The compressive spring force of the elastically deformable contacts hold the printed circuit board in engagement with the selected female connector.

By way of another example, U.S. Pat. No. 4,642,427 issued to Kratz et al. on Feb. 10, 1987 describes a switch for use in a printed circuit board having printed circuits on a surface thereof. One or more contact rollers are moveable by a slider relative to the surface to interact with the printed circuits to open or close the circuits associated therewith.

Switches integrally formed with printed circuit boards may have one or more problems which make them difficult to use and unreliable in operation. For example, the switch of the '610 patent may be difficult to use due to the force required to overcome the friction force between the mating contacts of the connectors. The switch of the '427 patent may be unreliable because there is not a structure which interacts with the rollers to bias them in their desired closed positions.

Accordingly, it would be desirable to provide an improved switch integrally formed with a printed circuit board which has reduced operating force and a simple structure which biases the switch in its desired positions.

SUMMARY OF THE INVENTION

The present invention relates to a switch including a non-conductive board including a substantially planar surface having at least one depression therein, at least two electrical conductors supported by the planar surface and terminating at the depression, and an electrically conductive rollable member. The switch also includes a switch member movably attached to the board. The rollable member is located within an opening in the switch member and the switch member is moveable relative to the board to a first position at which the rollable member rests within the depression. In one embodiment of the switch the rollable member is a sphere, and in another. embodiment, the rollable member may be a cylinder. The switch may also include a biasing member attached to the switch member and in contact with the rollable member to force the rollable member into the depression to electrically connect the electrical conductors.

The present invention also relates to a switch including means for supporting a circuit including a surface having at least one depression therein, at least two electrical conductors attached to the surface and terminating at the depression, and an electrically conductive sphere. A switch means is attached to the means for supporting and includes an opening. The sphere is located within the opening and the switch means is moveable relative to the board to a first position at which the sphere rests within the depression. The switch also includes a spring means for forcing the sphere against the board and into the depression to electrically connect the electrical conductors.

DETAILED DESCRIPTION OF THE PREFERRED EMBODIMENT

Figure 2:
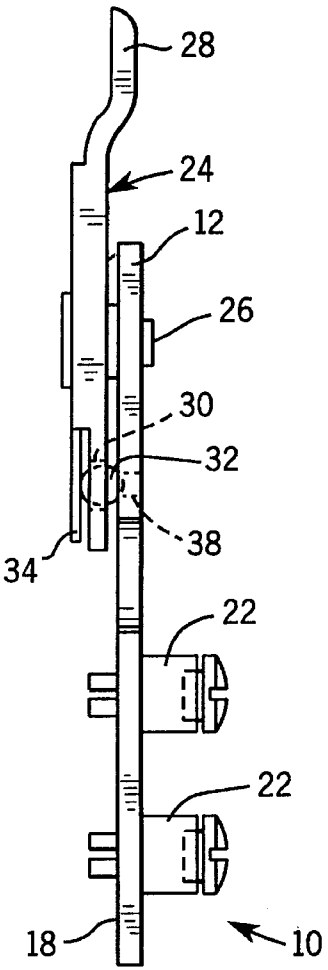
FIG. 2 is a side view of the switch.

Referring to the Figures, a switch 10 is integrally formed with a non-conductive printed circuit board 12. Circuit board 12 includes a plurality of pairs of electrical conductors 14, 16 (e.g., printed metallic (copper) circuits) supported by a top planar surface 18 of board 12. More specifically, conductors 14, 16 may be printed onto (i.e. attached to) surface 18. Each conductor 14, 16 may have a terminal pad 20 to which a wiring terminal 22 is attached. In particular, terminals 22 are fixed to board 12, and electrically connected to terminal pads 20 (e.g., soldered to).

Switch 10 also includes two switch members 24 (switch levers) which are movably supported by board 12 so that board 12 and levers 24 remain generally parallel (see FIG. 2). In the present embodiment of switch 10, levers 24 are pivotally attached to board 12 by respective pivot pins, rivets or studs 26 which pass through board 12 and lever 24. Levers 24 each include a distal end 28 at which an operator control knob may be attached. Accordingly, when the user of switch 10 applies an appropriate directional force to distal end 28, lever 24 is rotated about the center axis A of respective pin 26. Alternatively, levers 24 could be movably supported relative to board 12 by a slider arrangement which would result in linear motion of lever 24, rather than rotational motion. (By way of example, levers 24 may be fabricated from a material similar or the same as the material used for printed circuit boards.)

Figure 3:
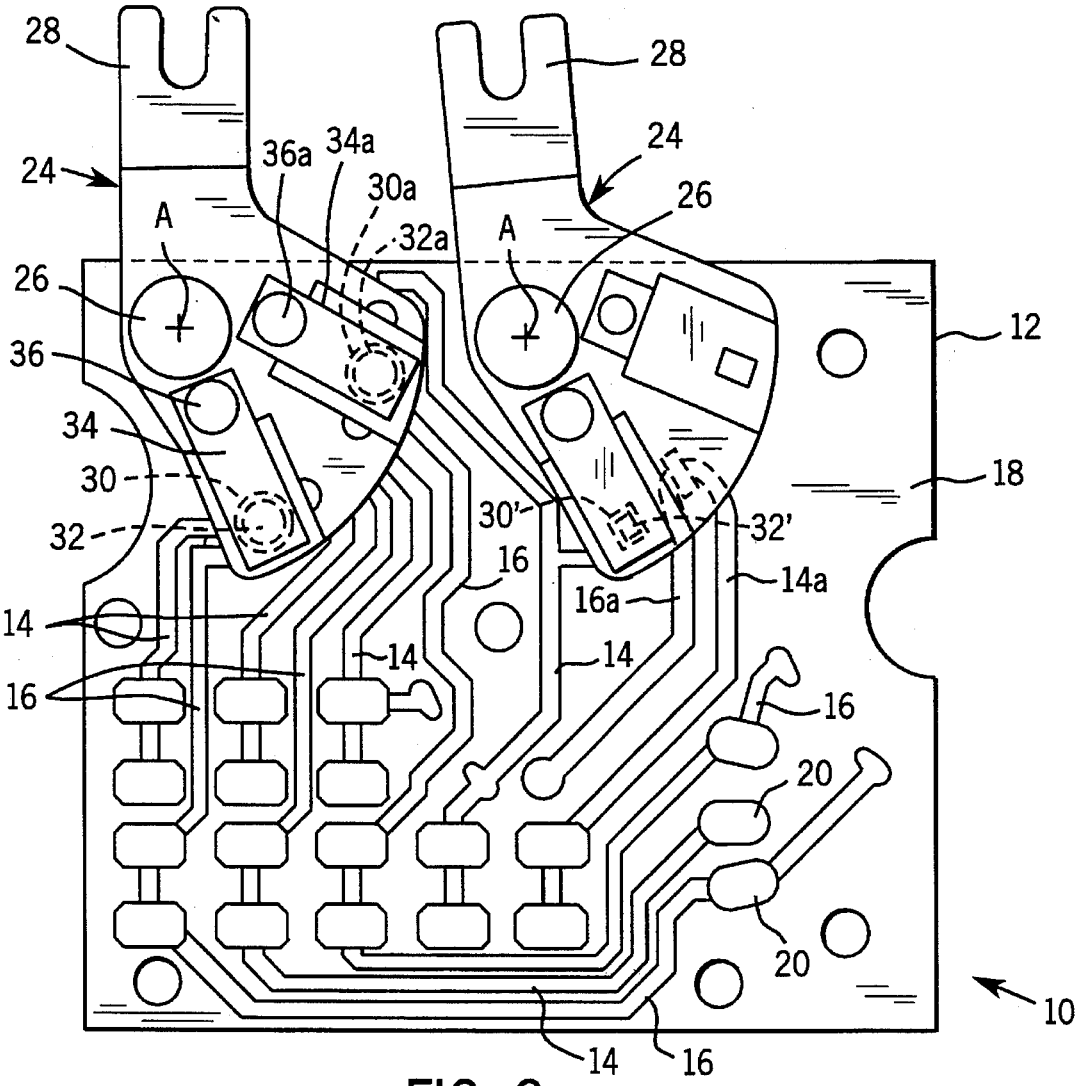
FIG. 3 is a top plan view of an alternative embodiment of a switch according to the present invention.

Each lever 24 includes at least one opening 30 (circular, square, etc.) within which an electrically conductive rollable member 32 is located. Depending upon the application, rollable member 32 may be either spherical or cylindrical in shape. For example, FIG. 3 shows an alternative embodiment of switch 10 including a square opening 30' in lever 24, and a rollable cylinder 32' located within opening 30'. Lever 24 also includes a biasing member such as a leaf spring 34 attached to lever 24 by a fastener such as a rivet 36. Leaf spring 34 contacts sphere 32 to bias or force sphere 32 against board 12 and circuits 14, 16 located thereon. By way of modification, leaf spring 34 could be replaced with an appropriate compression spring or spring and beam arrangement.

Figure 1:
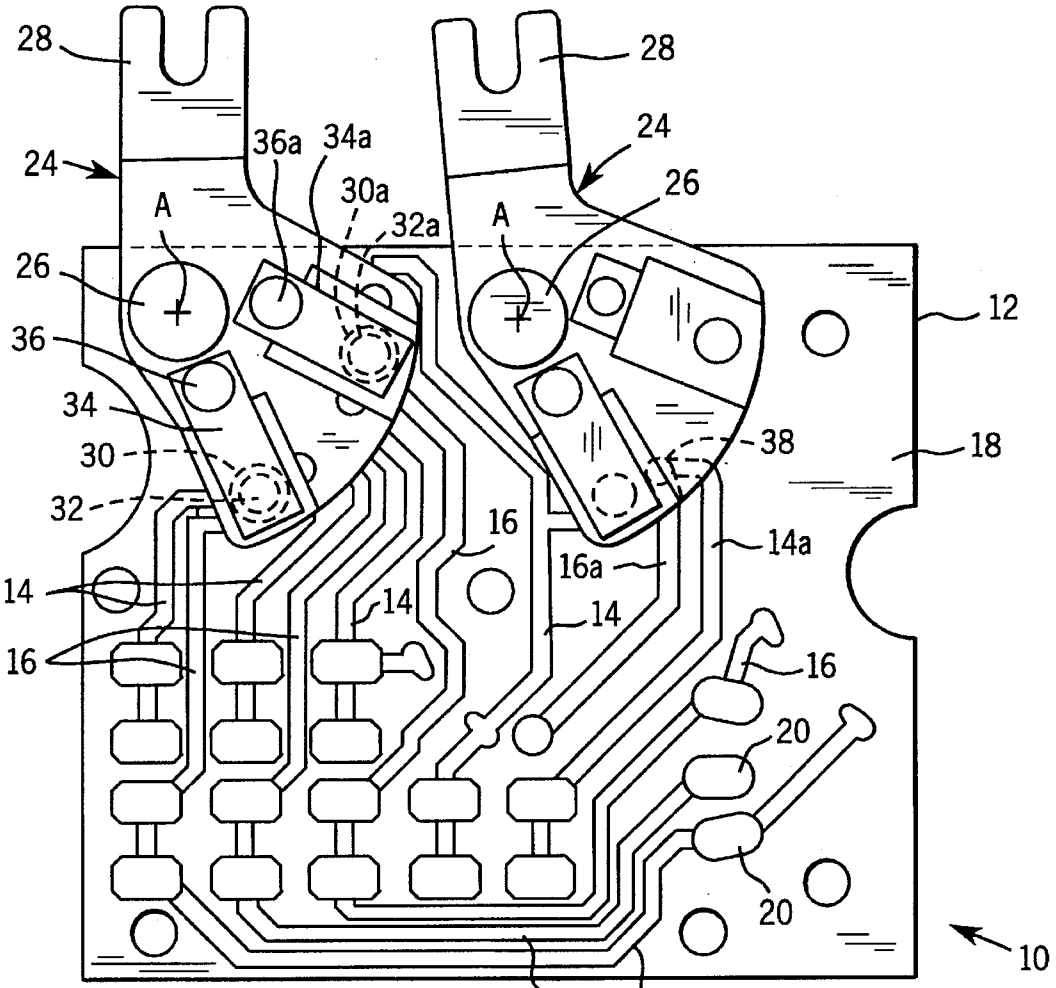
FIG. 1 is a top plan view of an embodiment of a switch according to the present invention.

Each pair of conductors 14, 16 terminates at a depression 38 formed within board 12 (see conductors 14*a* and 16*a* in FIG. 1). More specifically, depression 38 may be formed using a hole passing through board 12 having a radius which is less than the radius of sphere 32. As shown in FIG. 2, biasing member 34 forces sphere 32 against board 12 and into depression 38. Accordingly, lever 24 is biased into each position at which sphere 32 is located within a depression 38. Accordingly, since a depression 38 is located at the termination of each pair of conductors 14 and 16, lever 24 is biased at each location where sphere 32 provides an electrical path (i.e. completes the circuit) between the respective pairs of conductors 14, 16.

Depending upon the application for switch 10, lever 24 may include a second conductive sphere 32*a* and associated opening 30*a*, leaf spring 34*a*, and rivet 36*a*. This embodiment of lever 24 permits the simultaneous connection of two pairs of conductors 14, 16.

The structure of switch 10 provides a switch which requires reduced force to operate, and also provides feedback to the user to indicate that lever 24 is located at a position whereat conductive roller 32 connects a pair of conductors 14, 16. Additionally, the structure of switch 10 biases roller 32 in its selected position subsequent to being placed therein.

Although various features of the switch are described and illustrated in the drawings, the present invention is not necessarily limited to these features and may encompass other features disclosed both individually and in various combinations. For example, the spring member 34 may be replaced by lever 24 on spring mounted pivot pin 26 so that lever 26 is biased towards board 12 and thus forces the conductive member 32 onto surface 18 and into contact with the pairs of conductors 14, 16. It should be understood that the preferred embodiment has been provided by way of example and not by way of limitation and the scope of the invention is defined by the appended claims.

What is claimed is:

1. A switch comprising:

a non-conductive board including a substantially planar surface having at least one depression therein;

at least two electrical conductors supported by the planar surface and terminating at the depression;

an electrically conductive rollable member;

a switch member movably attached to the board, the switch member including an opening, wherein the rollable member is located Within the opening, and wherein the switch member is moveable relative to the board to a first position at which the rollable member rests within the depression and to a second position at which the rollable member is not within the depression; and a biasing member attached to the switch member and in contact with the rollable member to force the rollable member into the depression when the switch is in the first position to electrically connect the electrical conductors.

2. The switch of claim 1, wherein the conductors are printed circuits attached to the board.

3. The switch of claim 2, wherein the board is a printed circuit board.

4. The switch of claim 3, wherein the rollable member is a sphere.

5. The switch of claim 4, wherein the biasing member is a leaf spring fastened to the switch member and in contact with the sphere.

6. The switch of claim 5, wherein the sphere has a first radius, and the depression is formed from a hole having a second radius less than the first radius.

7. The switch of claim 3, further comprising a pivot pin passing through the printed circuit board and the switch member to pivotally mount the switch member to the board for rotational movement.

8. A switch comprising:

a non-conductive printed circuit board including a substantially planar surface having at least one depression therein;

at least two electrical conductors supported by the planar surface and terminating at the depression;

an electrically conductive cylinder;

a switch member movably attached to the board, the switch member including an opening, wherein the cylinder is located within the opening and the switch member is moveable relative to the board to a first position at which the cylinder rests within the depression; and a biasing member attached to the switch member and in contact with the cylinder to force the cylinder into the depression to electrically connect the electrical conductors.

9. The switch of claim 8, wherein the biasing member is a leaf spring fastened to the switch member and in contact with the cylinder.

10. A switch comprising:

a board including a substantially planar surface having at least one depression therein;

at least two electrical conductors supported by the planar surface and terminating at the depression;

an electrically conductive sphere; and a switch member movably attached to the board, the switch member including an opening, wherein the sphere is located within the opening and the switch member is moveable relative to the board to a first position at which the sphere rests within the depression and is forced into electrical contact with the electrical conductors, and wherein the switch member is moveable relative to the board to a second position at which the sphere is not within the depression.

11. The switch of claim 10, further comprising a spring member attached to the switch member and in contact with the sphere to force the sphere against the board and into the depression to electrically connect the electrical conductors.

12. The switch of claim 10, wherein the board is a printed circuit board and the conductors are printed circuits attached to the board.

13. The switch of claim 10, further comprising a pivot pin passing through the board and switch member to pivotally mount the switch member to the board for rotational movement.

14. The switch of claim 13, further comprising a spring member attached to the switch member and in contact with the sphere to force the sphere against the board and into the depression to electrically connect the electrical conductors.

15. The switch of claim 14, wherein the spring member is a leaf spring.

16. The switch of claim 15, wherein the sphere has a first radius, and the depression is formed from a hole in the board having a second radius less than the first radius.

17. The switch of claim 16, wherein the board is a printed circuit board and the conductors are printed circuits attached to the board.

18. A switch comprising:

means for supporting a circuit including a surface having at least one depression therein;

at least two electrical conductors attached to the surface, and terminating at the depression;

an electrically conductive sphere;

switch means attached to the means for supporting and including an opening, wherein the sphere is located within the opening, and wherein the switch means is moveable relative to the board to a first position at which the sphere rests within the depression and to a second position at which the sphere is not within the depression; and spring means for forcing the sphere against the board and into the depression when the switch is in the first position to electrically connect the electrical conductors.

19. The switch of claim 18, further comprising a pivot pin passing through the means for supporting and the switch means to pivotally mount the switch means to the means for supporting.

20. The switch of claim 19, wherein the spring means is a leaf spring.

21. The switch of claim 20, wherein the sphere has a first radius, the means for supporting is a printed circuit board, and the depression is formed from a hole in the board having a second radius less than the first radius.

22. The switch of claim 21, wherein the conductors are printed circuits attached to the board.

23. A switch comprising:

a non-conductive board including a substantially planar surface having at least one depression therein;

at least two electrical conductors supported by the planar surface and terminating at the depression;

an electrically conductive sphere;

a switch member movably attached to the board, the switch member including an opening, wherein the sphere is located within the opening and the switch member is moveable relative to the board to a first position at which the sphere rests within the depression; and a biasing member attached to the switch member and in contact with the sphere to force the sphere into the depression to electrically connect the electrical conductors;

wherein the sphere has a first radius, and the depression is formed from a hole having a second radius less than the first radius.

24. A switch comprising:

a board including a substantially planar surface having at least one depression therein;

at least two electrical conductors supported by the planar surface and terminating at the depression;

an electrically conductive sphere; and a switch member movably attached to the board, the switch member including an opening, wherein the sphere is located within the opening and the switch member is moveable relative to the board to a first position at which the sphere rests within the depression and is forced into electrical contact with the electrical conductors;

wherein the sphere has a first radius, and the depression is formed from a hole in the board having a second radius less than the first radius.

25. A switch comprising:

means for supporting a circuit including a surface having at least one depression therein;

at least two electrical conductors attached to the surface, and terminating at the depression;

an electrically conductive sphere;

switch means attached to the means for supporting and including an opening, wherein the sphere is located within the opening and the switch means is moveable relative to the board to a first position at which the sphere rests within the depression; and spring means for forcing the sphere against the board and into the depression to electrically connect the electrical conductors;

wherein the sphere has a first radius, the means for supporting is a printed circuit board, and the depression is formed from a hole in the board having a second radius less than the first radius.

* * * * *